US005155001A

United States Patent [19]

Landa et al.

[11] Patent Number: 5,155,001

[45] Date of Patent: Oct. 13, 1992

[54] LIQUID DEVELOPER METHOD WITH REPLENISHMENT OF CHARGE DIRECTOR

[75] Inventors: Benzion Landa, Edmonton, Canada; Yaacov Almog, Rehovot; Amnon Peled, Holon, both of Israel

[73] Assignee: Spectrum Sciences B.V., Rotterdam, Netherlands

[21] Appl. No.: 742,485

[22] Filed: Aug. 5, 1991

Related U.S. Application Data

[63] Continuation of Ser. No. 319,126, Mar. 6, 1989, abandoned.

[51] Int. Cl.[5] ..... G03G 13/10; G03G 13/22

[52] U.S. Cl. ..... 430/115; 430/137

[58] Field of Search ..... 430/115, 137

[56] References Cited

U.S. PATENT DOCUMENTS

| | | | |
|---|---|---|---|
| 3,669,886 | 6/1972 | Kosel | 430/115 |
| 4,003,500 | 1/1977 | Schornig | 222/133 |
| 4,193,683 | 3/1980 | Langner | 355/256 |
| 4,306,009 | 12/1981 | Veillette et al. | 430/115 |
| 4,521,505 | 6/1985 | Podszun et al. | 430/115 X |
| 4,656,966 | 4/1987 | Guistina | 430/119 |
| 4,740,444 | 4/1988 | Trout | 430/137 |
| 4,785,327 | 11/1988 | Landa et al. | 430/115 |
| 4,812,382 | 3/1989 | Bugner et al. | 430/110 |
| 4,860,050 | 8/1989 | Kurotori et al. | 430/115 |
| 4,860,924 | 8/1989 | Simms et al. | 355/256 |
| 4,869,991 | 9/1989 | Degraft-Johnson et al. | 430/115 |
| 4,980,259 | 12/1990 | Landa et al. | 430/115 X |
| 5,012,300 | 4/1991 | Levanon et al. | 430/32 X |

*Primary Examiner*—Roland Martin

*Attorney, Agent, or Firm*—Sandler, Greenblum & Bernstein

[57] ABSTRACT

A liquid developer system contains electrically charged toner particles that are applied to a surface having a latent electrostatic image thereon for developing the image. The liquid developer system includes an insulating non-polar carrier liquid, toner particles dispersed in the carrier liquid, and at least one charge director compound that is only partially soluble in the carrier liquid. The charge director compound is supplied in solid form to the carrier liquid in excess of the amount that achieves saturation concentration. As a result, the compound is in equilibrium contact with the carrier liquid and maintains a predetermined concentration of dissolved charge director in the liquid developer system.

18 Claims, No Drawings

LIQUID DEVELOPER METHOD WITH REPLENISHMENT OF CHARGE DIRECTOR

This application is a continuation of application Ser. No. 07/319,126, filed Mar. 6, 1989, now abandoned.

FIELD OF THE INVENTION

This invention relates to the field of electrostatic imaging, and more particularly to a liquid developer system having improved properties.

BACKGROUND OF THE INVENTION

In the art of electrostatic photocopying or photoprinting, a latent electrostatic image is generally produced by first providing a photoconductive imaging surface with a uniform electrostatic charge, e.g. by exposing the imaging surface to a charge corona. The uniform electrostatic charge is then selectively discharged by exposing it to a modulated beam of light corresponding, e.g., to an optical image of an original to be copied, thereby forming an electrostatic charge pattern on the photoconductive imaging surface, i.e. a latent electrostatic image. Depending on the nature of the photoconductive surface, the latent image may have either a positive charge (e.g. on a selenium photoconductor) or a negative charge (e.g. on a cadmium sulfide photoconductor). The latent electrostatic image can then be developed by applying to it oppositely charged pigmented toner particles, which adhere to the undischarged "print" portions of the phtoconductive surface to form a toner image which is subsequently transferred by various techniques to a copy sheet (e.g. paper).

In liquid-developed electrostatic imaging, the toner particles are generally dispersed in an insulating non-polar liquid carrier, generally an aliphatic hydrocarbon fraction, which generally has a high-volume resistivity above $10^9$ ohm-cm, a dielectic constant below 3.0 and a low vapor pressure (less then 10 torr. at 25° C.). The liquid developer system further comprises so-called charge directors, i.e. compounds capable of imparting to the toner particles an electrical charge of the desired polarity and uniform magnitude so that the particles may be electrophoretically deposited on the photoconductive surface to form a toner image. These charge director compounds are generally ionic or zwitterionic compounds which are soluble in the non polar carrier liquid. This desired charging is achieved by providing a constant optimum concentration of charge director compound in the carrier liquid, which concentration is usually determined so as to achieve the highest copy quality for the particular application.

Stable electrical characteristics of the liquid developer, in particular its bulk conductivity, are crucial to achieve high quality imaging, particularly when a large number of impressions are to be produced without changing the liquid developer system. A major factor determining the electrical characteristics of the liquid developer and affecting the electrophoretic developing process of the toner particles, is the concentration of the charge director in the carrier liquid. Thus, one of the major problems arising in liquid-developed electrostatic imaging is the variation in the charge director concentration and it is believed that many low quality copies are a result of charge director imbalance in the liquid developer system.

The application of liquid developer to the photoconductive surface clearly depletes the overall amount of liquid developer in the reservoir of an electrocopying or electroprinting machine of this type. In practice, the liquid reservoir is continuously replenished, as necessary, by addition of two liquids from two separate sources, the one providing carrier liquid and the other-a concentrated dispersion of toner particles in the carrier liquid. This is necessary in order to maintain in the carrier liquid in the reservoir a relatively constant concentration of toner particles, because the total amounts of carrier liquid and toner particles utilised per electrocopy vary as a function of the proportional area of the printed portions of the latent image on the phtoconductive surface. An original having a large proportion of printed area will cause a greater depletion of toner particles in the liquid developer reservoir, as compared to an original with a small proportion of printed area. Thus, in accordance with the aforementioned practice, the rate of replenishment of carrier liquid is controlled by monitoring the overall amount or level of liquid developer in the reservoir, whereas the rate of replenishment of toner particles (in the form of a concentrated dispersion in carrier liquid) is controlled by monitoring the concentration of toner particles in the liquid developer in the reservoir. An optical float can combine both these functions, i.e. can be utilized to monitor both the overall amount of liquid developer in the reservoir and the toner particle concentration therein.

The amount of charge director in the liquid developer reservoir must also be replenished, since the charge director is also depleted together with the carrier liquid and the toner 20 particles. In existing liquid-developed electrostatic imaging machines the charge director is replenished by adding it with the carrier liquid replenishment or with the concentrated toner dispersion. As explained hereinbelow, this results in charge director imbalance in the liquid developer system with consequent impairment of the quality of the copies.

As discussed above, the amount of toner particles utilized per electrocopy varies in proportion to the relative printed area of the image. Thus, a large number of so-called "white" copies (i.e. originals with small printed areas) will result in very small depletion of toner particles whereas the amount of carrier liquid depleted will be comparatively large. This amount of carrier liquid will be replenished and, in machines designed for adding the charge director only with the replenished carrier liquid, this will result in an increase of the concentration of charge director relative to the toner concentration. It can easily be seen that an opposite result will be observed in a photocopier machine designed so that the charge director is replenished together with the concentrated toner suspension only. In such machines a large number of "white" copies will cause a decrease in the concentration of charge director in the liquid developer system.

Similarly, a large number of "black" copies (i.e. originals with large printed areas) will cause a degradation of copy quality in opposite directions to the above. In machines wherein charge director is added with the carrier liquid only, a large number of black copies will reduce the concentration of charge director in the liquid developer, resulting in degraded copies. Against this, in machines where charge director is added to the reservoir with the concentrated toner suspension only, its concentration in the liquid developer will be increased by a larger number of black copies, resulting in lighter than optimal copies.

A possible solution to the above problem of charge director imbalance in the liquid developer would be to monitor separately the concentration of the charge director and replenish it separately from a separate source. This solution, however, is uneconomic, because it would involve the cost and complexity of providing additional measurement devices and replenishment mechanism. It follows that a simpler and more feasible solution to the problem is needed.

It is an object of the present invention to provide a solution to the problem of charge director imbalance in liquid developer systems, thereby to maintain a constant high-quality of copies in electrostatic imaging processes, independent of the "print" proportions of the originals.

Other objects and advantages of the present invention will become clear from the following description of the invention.

SUMMARY OF THE INVENTION

The above object is achieved by the present invention which, in accordance with one aspect thereof, provides a self-replenishing liquid developer system for use in electrostatic imaging, which system comprises:

an insulating non-polar carrier liquid;

toner particles dispersed in said carrier liquid;

at least one charge director compound having a limited solubility in said carrier liquid and dissolved therein at its saturation concentration; and excess of said at least one charge director compound comprised in a solid phase and being in equilibrium contact with said carrier liquid.

The present invention is based on the concept of using a charge director compound which has a limited low solubility in the carrier liquid, such that the saturation concentration of the charge director in the carrier liquid is at a proper concentration as to bring about the electrical charging of the toner particles, to disperse them and to maintain them at the desired degree of dispersion. When such a saturated solution of charge director in the carrier liquid is maintained in contact with a solid phase comprising or consisting of a considerable excess of the charge director compound, this solid phase will serve as a reservoir for the charge director compound. Whenever the concentration of this charge director in the liquid phase, i.e. in the carrier liquid in contact with the solid phase, falls below its saturation concentration value, it will be rapidly equilibrated with the excess charge director in the solid phase so that the saturation concentration of the charge director in the carrier liquid is constantly and automatically maintained. As shown in the following, non-limiting examples, suitable charge director-carrier liquid-toner systems can be found which have the desired characteristics.

In accordance with one embodiment of the present invention, it is the toner particles themselves which serve as the solid phase comprising the excess charge director compound. To this end, from about 5 to about 10% by weight of charge director compound, based on the total weight of the imaging material, are milled together with the remaining ingredients of the imaging material to form the toner particles.

In accordance with this embodiment the concentration of the charge director compound is continuously maintained by natural and rapid equilibration between the charge director in solution in the carrier liquid and the excess charge director comprised in the toner particles. When, for example, a large number of white copies are made, resulting in a replenishment of pure carrier liquid thereby lowering the concentration of charge director in the liquid developer, some charge director compound will diffuse from the solid phase, i.e. from within the toner particles, into the carrier liquid until dynamic equilibrium is reached when the concentration of charge director in the carrier liquid reaches its saturation value. In the opposite case, where a large number of "black" copies are made, consuming a relatively high proportion of toner particles as compared to the consumed carrier liquid, the resultant replenishment of concentrated suspension of toner particles in carrier liquid into the reservoir, would not affect the concentration of charge director because the added carrier liquid in said concentrated suspension will already be saturated with the charge director compound owing to the presence of excess of that compound in the toner particles in that concentrated suspension.

In accordance with an alternative embodiment of the present invention, the excess of charge director compound, preferably in the form of a finely dispersed powder, is contained in a container, at least a portion of the walls of which being made of a porous material which is permeable to the carrier liquid but does not permit the passage therethrough of the particulate solid charge director compound. Such container will be wholly or partially immersed in the reservoir of liquid developer so as to be in direct contact therewith. A suitable container may be, for example a closed bag made of thin porous sheet material, e.g. filter paper or the like. In this embodiment of the invention, the liquid developer is always in direct equilibrium contact with the excess charge director in solid form, thereby achieving a constant saturation concentration of charge director in the liquid developer.

The invention will be further described by the following, non-limiting examples, all of which relate to negative-working liquid developer systems, i.e. those in which the toner particles are negatively charged. It should be understood, however, that the invention is not limited to such negative-working liquid developers, but is rather equally applicable to positive-working liquid developer systems. It should also be understood that the invention is not limited to the specific toner of Preparation 1 herein nor to the specific carrier liquids exemplified, but rather extends to all modifications falling within the scope of the claims.

PREPARATION I

Preparation of Black Imaging Material

Black imaging material which is used in in Examples 1 to 5 hereinbelow is prepared as follows:

10 parts by weight of Elvax 5720 (E.I. Du Pont), and 5 parts by weight of Isopar L (Exxon) are mixed at low speed in a jacketed double planetary mixer connected to an oil heating unit, for 1 hour, the heating unit being set at 130° C.

A mixture of 2.5 parts by weight of Mogul L carbon black (Cabot) and 5 parts by weight of Isopar L is then added to the mix in the double planetary mixer and the resultant mixture is further mixed for 1 hour at high speed. 20 parts by weight of Isopar L preheated to 110° C. are added to the mixer and mixing is continued at high speed for 1 hour.

The heating unit is then disconnected and mixing is continued until the temperature of the mixture drops to 40° C.

EXAMPLE 1

Calcium Laurylbenzenesulfonate in Toner Particles

Calcium laurylbenzenesulfonate was prepared from its 68–70% solution in xylol and isobutanol commercially available under the name Emcol P-1020 (Witco), by one of the following methods:

1) Emcol P-1020 is subjected to vacuum distillation at 170° C. The solid residue is allowed to equilibrate with air moisture and dissolved in Isopar H at the desired concentration.
2) The Emcol P-1020 is diluted with Isopar H to a 10% content of non volatile solids (n.v.s.) and the obtained solution is allowed to stand at room temperature whereupon a yellow sediment is formed followed within 30–35 days by precipitation of a white material which is separated and dissolved in Isopar H at the desired concentration.

The crude material thus obtained is washed repeatedly with Isopar H with stirring until a constant conductance in the supernatant Isopar H solution is reached. The resultant solid residue was dried.

The solubility of calcium laurylbenzensulfonate in Isopar H was determined by U.V. spectrophtometry and found to be 0.069% by weight.

Preparation of the Liquid Developer

One part by weight of the solid dry calcium lauryl benzenesulfonate was co-melted with 9 parts by weight of black imaging material at 130° C. The melt was cooled and 100 g thereof and 120 g of Isopar L were milled together for 19 hours in an attritor to obtain a dispersion of particles with an average diameter of about 2μ. The attrited material obtained was washed several times with Isopar H and then dispersed in Isopar H at a content of 1% n.v.s. The conductance of the toner was 3 pmho/cm.

The performance of the developer was tested in a Savin V-35 photocopier machine using both Savin 2200+ and Printers Stock copy sheets. The results obtained are summarised in the following Table 1.

TABLE 1

| Substrate | Solid Area Density (SAD) | Fixing | Bleed through (SAD) |
|---|---|---|---|
| Savin 2200 + | 1.51 | good | 0.15 |
| Printers Stock | 1.67 | good | 0.09 |

EXAMPLE 2

Sodium Laurylbenzenesulfonate in Toner

The title material was purchased from Fluka and used without further treatment, after being left to equilibrate with air moisture. The material was repeatedly washed with Isopar H until a constant conductance of the supernatant solution was reached.

The solubility of sodium laurylbenzenesulfonate in Isopar H was determined spectrophotometrically to be 0.027% by weight.

Preparation of the Liquid Developer

One part of weight of sodium laurylbenzenesulfonate was co-melted with 9 parts by weight of black imaging material. 100 g of the co-melt was mixed with 120 g of Isopar G and attrited as described in Example 1 to give an average particle size of about 1.9μ. The final developer, after washing, had a conductance of 5.5 pmho/cm at a concentration of 1% n.v.s. in Isopar G. It was placed in the developer bath of a Savin 870 photocopier and the performance on various substrates was tested. The results are shown in the following Table 2.

TABLE 2

| Substrate | S.A.D. | Transfer efficiency % |
|---|---|---|
| Gilbert Bond | 1.33 | 72 |
| Printers Stock | 1.64 | 87 |

EXAMPLE 3

Sodium Diamyl Sulfosuccinate in Toner

The title material is commercially available under the name Aerosol AY (Cyanamide). It was used without further treatment, except for equilibration with the air humidity and successive washing with Isopar H to constant conductance (about 1–2 pmho/cm).

Preparation of the Developer

5 Parts of sodium diamyl sulfosuccinate and one part of aluminium stearate were co-melted with 44 parts by weight of black imaging material in accordance with the procedure of black imaging material in accordance with the procedure described in Example 1. 100 g of the co-melt were added to 120 g of Isopar H and milled for 19 hours as described in Example 1. The milled toner thus obtained was washed several times with Isopar and diluted with Isopar G to a 1% n.v.s. content of toner.

The obtained dispersion was placed in the developer bath of a Savin 870 photocopier and the performance tested on various substrates. The results are summarised in the following Table 3.

TABLE 3

| Substrate | S.A.D. | Transfer Efficiency (%) |
|---|---|---|
| Savin 2200 + | 1.32 | 84 |
| Gilbert Bond | 1.61 | 63 |

EXAMPLE 4

Calcium Laurylbenzenesulfonate in Filter Paper Bag.

The material obtained as described in Example 1 was placed in a bag prepared from folded Whatman MN filter paper, and the bag was immersed in a liquid developer and the conductance of the liquid developer measured. From time to time the bag was removed from the liquid developer which was centrifuged to remove the supernatant and the resultant toner particles were redispersed in pure Isopar H. Thereafter, the filter paper bag containing the charge director compound was reinstalled and after several hours of stirring the conductivity of the liquid developer was measured again. To eliminate effects related to possible permeation of the charged toner particles through the filter paper, the conductance values obtained were compared with those of an identical control bag immersed in pure Isopar H.

It was found that the conductance of the liquid developer surrounding the bag reached a time-independent steady-state value of about 4 pmho/cm at a toner concentration of 1% n.v.s. The same conductance value was observed when the bag was removed from the toner suspension and immersed in pure isopar H.

Measurements in a test plating cell showed negative plating with the above described liquid developer system.

EXAMPLE 5

When the procedure of Example 4 was repeated with sodium laurylbenzenesulfonate (in Isopar H), calcium diisobutyl sulfosuccinate (in Isopar G) and sodium diamyl sulfosuccinate (in Isopar H using a bag made from Whatman No. 2 filter paper), similar results as in Example 4 were obtained.

In all the above cases, a steady-state conductance was reached and significant charge transport followed by negative plating were observed in the test cell. In the case of calcium diisobutyl sulfosuccinate a markedly low conductance of 0.5–2 pmho/cm was measured (at toner concentration of 1% n.v.s.), but this did not affect the pronounced charge transport and the negative plating in the cell.

What is claimed is:

1. An electrostatic imaging process comprising the steps of:

forming a latent electrostatic image on a surface;

applying to said surface electrically charged toner particles from a liquid developer system comprising:

an insulating non-polar carrier liquid;

toner particles dispersed in said carrier liquid; and at least one charge director compound being partly soluble in said carrier liquid and dissolved therein at its saturation concentration; thereby to form a toner image on said surface; and supplying an excess of said charge director compound above such saturation concentration comprised in a solid phase, said solid being in equilibrium contact with said carrier liquid for maintaining a predetermined concentration of dissolved charge director in said liquid developer system; and transferring the resulting toner image to a substrate.

2. A liquid developer system according to claim 1 wherein said solid includes particles.

3. A process according to claim 1 wherein said excess of charge director compound is in a finely dispersed solid form external to said toner particles and in contact with said carrier liquid.

4. A process according to claim 1, wherein said carrier liquid is a branched chain aliphatic hydrocarbon or a mixture of such hydrocarbons.

5. A process according to claim 1 wherein said carrier liquid is an isoparaffinic hydrocarbon fraction having a boiling range above 155°·C.

6. A process according to claim 1, wherein said charge director compound is ionic or zwitterionic.

7. A process according to claim 6, wherein said charge director compound is a metal soap.

8. A process according to claim 1, wherein said charge director compound is capable of imparting a negative charge to the toner particles suspended in the carrier liquid.

9. A process according to claim 7, wherein said charge director compound is calcium laurylbenzenesulfonate.

10. A process according to claim 7, wherein said charge director compound is sodium laurylbenzenesulfonate.

11. A process according to claim 7, wherein said charge director compound is sodium diamyl sulfosuccinate.

12. An electrostatic imaging process according to claim 1 wherein said step of forming comprises the steps of:

electrostatically charging a photoconductive surface;

exposing said photoconductive surface to an optical image thereby forming a latent electro static image on said photoconductive surface.

13. An imaging method including the steps of:

developing a latent electrostatic image utilizing a liquid developer system comprising:

an insulating non-polar carrier liquid;

toner particles dispersed in said carrier liquid; and at least one charge director compound being partly soluble in said carrier liquid and dissolved therein at its saturation concentration; and supplying an excess of said charge director compound above such saturation concentration comprised in a solid phase, said solid being in equilibrium contact with said carrier liquid for maintaining a predetermined concentration of dissolved charge director in said liquid developer system.

14. An electrostatic imaging process according to claim 1 wherein said excess of charge director compound is comprised in said toner particles.

15. An electrostatic imaging process according to claim 12 wherein said excess of charge director compound is comprised in said toner particles.

16. A method for developing a latent electrostatic image in a liquid-developed electrostatic imaging process according to claim 13 wherein said excess of charge director compound is comprised in said toner particles.

17. An electrostatic imaging process according to claim 12 wherein said excess of charge director compound is in a finely dispersed solid form external to said toner particles and in contact with said carrier liquid.

18. A method for developing a latent electrostatic image in a liquid-developed electrostatic imaging process according to claim 13 wherein said excess of charge director compound is in a finely dispersed solid form external to said toner particles and in contact with said carrier liquid.

* * * * *